US007854369B2

(12) United States Patent
Keefe

(10) Patent No.: US 7,854,369 B2
(45) Date of Patent: Dec. 21, 2010

(54) INTEGRATED ENVELOPE AND REPOSITIONABLE NOTE

(75) Inventor: Richard Ignatius Keefe, Rock Falls, IL (US)

(73) Assignee: MailAgain, LLC, Houston, TX (US)

( * ) Notice: Subject to any disclaimer, the term of this patent is extended or adjusted under 35 U.S.C. 154(b) by 1047 days.

(21) Appl. No.: 11/634,344

(22) Filed: Dec. 5, 2006

(65) Prior Publication Data

US 2008/0128477 A1 Jun. 5, 2008

(51) Int. Cl.
*B65D 27/00* (2006.01)
*B65D 27/06* (2006.01)

(52) U.S. Cl. ..... 229/68.1; 229/300; 229/305; 229/70

(58) Field of Classification Search ..... 229/300, 229/305, 70, 68.1
See application file for complete search history.

(56) References Cited

U.S. PATENT DOCUMENTS

| | | | | |
|---|---|---|---|---|
| 1,245,447 | A | 11/1917 | Felenchak | |
| 1,491,675 | A | 4/1924 | Conklin | |
| 1,568,880 | A | 1/1926 | Conklin | |
| 1,588,875 | A | 6/1926 | Curtis | |
| 1,886,348 | A | 11/1932 | Millan | |
| 1,988,909 | A | 1/1935 | MacKinnon | |
| 3,380,648 | A | 4/1968 | Lyra | |
| 3,545,669 | A | 12/1970 | Kinkade et al. | |
| 3,912,160 | A | 10/1975 | Gendron | |
| 3,952,942 | A | 4/1976 | O'Leary et al. | |
| 3,968,927 | A | 7/1976 | Katz et al. | |
| 3,995,808 | A | 12/1976 | Kehoe | |
| 3,998,138 | A | 12/1976 | Walters | |
| 4,093,117 | A | 6/1978 | Morse | |
| 4,495,318 | A | 1/1985 | Howard | |
| 4,637,633 | A | 1/1987 | Instance | |
| 4,773,584 | A | 9/1988 | Instance | |
| 4,775,095 | A | 10/1988 | Emmott | |
| 4,778,100 | A | 10/1988 | McGuire et al. | |
| 4,781,306 | A | 11/1988 | Smith | |
| 4,846,553 | A | 7/1989 | Rice | |
| 4,852,794 | A | 8/1989 | Bennett et al. | |
| 4,951,969 | A * | 8/1990 | Epstein et al. | 283/67 |
| 5,009,518 | A | 4/1991 | Faltynek | |
| 5,011,189 | A | 4/1991 | Olson | |
| 5,052,613 | A * | 10/1991 | Lin | 229/303 |
| 5,056,824 | A | 10/1991 | Olson | |
| 5,249,827 | A | 10/1993 | Olson | |
| 5,299,835 | A | 4/1994 | Sonnenberg | |
| 5,390,819 | A | 2/1995 | Kaye | |
| 5,415,341 | A | 5/1995 | Diamond | |
| 5,641,182 | A | 6/1997 | Schwandt | |
| 5,755,375 | A | 5/1998 | Rogers | |
| 5,967,403 | A | 10/1999 | Kranz | |
| 5,997,043 | A | 12/1999 | Dahlquist | |
| 6,254,138 | B1 | 7/2001 | Rawlings et al. | |
| 6,268,032 | B1 * | 7/2001 | Mertens et al. | 428/40.1 |
| 6,269,158 | B1 | 7/2001 | Kim | |
| 6,352,198 | B1 | 3/2002 | Flynn et al. | |
| 6,403,188 | B1 * | 6/2002 | Donahue | 428/40.1 |

(Continued)

*Primary Examiner*—Jes F Pascua
(74) *Attorney, Agent, or Firm*—Erickson Law Group, PC

(57) ABSTRACT

An envelope includes a front wall and an overlying back wall. The front wall and the back wall are connected around mutual edges to form an enclosed pouch. One of the front wall and the back wall includes a message portion separable from remaining portions of the one of the front wall and the back wall. A release sheet is secured to an inside surface of the one of the front wall and the back wall overlying the message portion. The message portion comprises areas of removable adhesive or multiple reuse adhesive and is secured to the release sheet by the multiple reuse adhesive to form a repositionable note once removed from the one of the front wall and the back wall.

17 Claims, 3 Drawing Sheets

U.S. PATENT DOCUMENTS

| | | | | |
|---|---|---|---|---|
| 6,435,967 | B1 | 8/2002 | Michlin | |
| 6,540,131 | B2 | 4/2003 | Black | |
| 6,703,096 | B2 | 3/2004 | Sabella | |
| 6,948,742 | B2 | 9/2005 | Buck | |
| 2005/0179255 | A1* | 8/2005 | Olson | 283/105 |
| 2005/0252954 | A1* | 11/2005 | Buck | 229/92.1 |
| 2006/0032896 | A1* | 2/2006 | Bethke et al. | 229/92.3 |
| 2006/0219769 | A1 | 10/2006 | DeLaVergne | |
| 2006/0231605 | A1 | 10/2006 | Collins | |

* cited by examiner

INTEGRATED ENVELOPE AND REPOSITIONABLE NOTE

TECHNICAL FIELD OF THE INVENTION

The present invention is directed to envelope construction and more particularly to envelope construction for direct mail advertising.

BACKGROUND OF THE INVENTION

It is known to advertise by mailing advertising literature directly to potential customers. Such mail effectively utilizes the envelope as an advertising space in addition to the advertising provided by sheets of paper contained by the envelope.

It is also known to provide advertising envelopes that utilize a repositionable note attached to the outside of the envelope wherein the repositionable note contains further advertising or information. The repositionable note presents an eye-catching advertising vehicle and can be conveniently used. Repositionable notes are small pieces of paper having multiple re-use adhesive applied on a surface of the paper such that the paper can be removed and re-adhered to another object. One example of repositionable notes are Post-It® notes sold by the 3M Company of St. Paul, Minn., U.S., and which are widely commercially available. One drawback to the advertiser in using this method is that the repositionable note can become dislodged during mailing and the U.S. Postal Service also charges a surcharge for bulk mailings having repositionable notes attached in this manner.

The present inventor has recognized that it would be desirable to provide an envelope that incorporated a repositionable note but which would be more reliably mailed and at a reduced cost.

SUMMARY OF THE INVENTION

The invention provides an envelope that includes a front wall and an overlying back wall. The front wall and the back wall are connected around mutual edges to form an enclosed pouch. One of the front wall and the back wall includes a message portion separable from remaining portions of the one of the front wall and the back wall. A release sheet is secured to an inside surface of the one of the front wall and the back wall overlying the message portion. The message portion comprises areas of "removable adhesive" or "multiple reuse adhesive" and is secured to the release sheet by the multiple reuse adhesive to form a repositionable note once removed from the one of the front wall and the back wall.

Preferably, the envelope comprises a pattern of adhesive applied between the one of the front wall and the back wall and the release sheet, and the release sheet is secured to the one of the front wall and the back wall by the pattern. The pattern can substantially continuously surround the message portion.

Preferably, the multiple reuse adhesive comprises an acrylic, microsphere adhesive system which provides a discontinuous film of adhesive resulting in low peel, removability and stable tack over a period of time.

The multiple reuse adhesive can comprise a first portion substantially spanning a top edge portion of the message portion and a second portion substantially spanning a bottom edge portion of the message portion. The second portion can be smaller in area than the first portion.

According to one embodiment, the message portion is formed by perforating the one of the front wall and the back wall to make the message portion removable from the remaining portions.

According to another embodiment the message portion is completely separate from the remaining portions and secured to the release portion by the multiple reuse adhesive.

The message portion can comprise a fold line that defines two equal area halves of the message portion, wherein the multiple reuse adhesive is arranged to secure the two equal halves together once separated from the remaining portions and folded, to form a two ply message portion.

The invention provides an integrated repositionable note envelope that can be constructed of a single sheet or base web of paper that is printed, die cut, and folded with pattern removable adhesive or multiple use adhesive to form an envelope. As the removable adhesive is applied a second patch of paper or release sheet is attached to create a barrier to avoid transfer of the removable adhesive to the contents of the envelope. The base web of paper, that forms the envelope, is kiss cut and/or die cut, perforated or clean cut which forms the message portion in the shape of a rectangle or other shape. The cutting or perforating facilitates the removal of the message portion or label that is a unique feature of this envelope design. Once removed, the message portion or label becomes a repositionable note.

In use, the recipient of the envelope lifts, separates and removes the message portion which has been integrated into the front or rear panel of the envelope. Once removed the message portion can be re-adhered using the removable adhesive to another object such as to a notebook, a telephone directory, a computer monitor frame, a refrigerator surface or message board, or other object wherein the message portion serves as a reminder to the recipient.

Thus, the envelope provides a useful direct mail advertising vehicle. The recipient of the envelope can open the envelope to read the advertising literature contained therein and also remove the eye-catching message portion on the outside of the envelope. In fact, the recipient need not even open the envelope to make use of the message portion. Important advertising information can be applied to the message portion such as a company's address, phone number, web address and/or email address could be on the message portion. A busy recipient may desire to just retain the message portion rather than the more voluminous contents of the envelope.

Furthermore, because the message portion is integrated into the front or rear panel of the envelope, the message portion is more compatible with mailing machines and is not subject to a U.S. Postal Service surcharge otherwise applied to external repositionable notes. This further enhances the economical benefit of the present invention.

Standard sizes or customs sizes for the envelope are possible, with the standard of a #10—4⅛"×9½" being one size advantageous for this integrated repositionable note or label.

This invention also provides for the integration of an ID card or store valued card, coupons or other integrated label devices in the construction method.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENT

Figure 1:
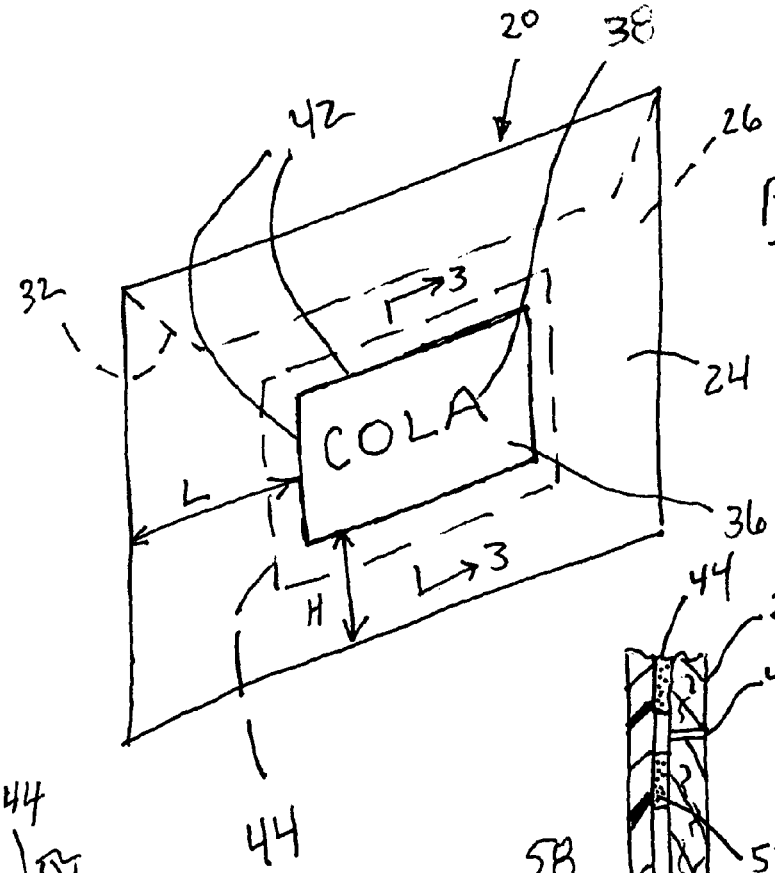
FIG. 1 is a front perspective view of a mailing envelope incorporating the present invention.

While this invention is susceptible of embodiment in many different forms, there is shown in the drawings and will herein be described in detail preferred features of the invention. It will be understood, however, that the present disclosure is to be considered as an exemplification of the principles of the invention and is not intended to limit the invention to the specific form of the combination of features that are illustrated and described.

FIG. 1 illustrates an envelope 20 incorporating the present invention. The envelope has a front panel 24 and a rear panel 26 formed by a folded single sheet of paper or blank 28 (shown in FIG. 2) or like-material. A flap 32 folds over from the front panel 24 and is adhesively secured to the back panel 26 by an adhesive region 33. The back panel 26 is comprised of side panels 26*a*, 26*b* and center panel 26*c* folded together from the blank 28 and secured together. This construction is conventional.

A message portion 36 is located within the front panel 24. Alternately, the message portion 36 could be located within the back panel. The message portion is preferably rectangular, but other shapes including irregular shapes are encompassed by the invention as well. The message portion could contain an advertising message 38 such as the word "COLA" shown in FIG. 1. Other indicia could be displayed in the message portion such as contact information, game information, coupon information, etc. The message portion can be a continuous portion of the front panel 24 separated or otherwise defined around its border 42 by cuts or perforations. The cuts or perforations can have a continuous, regular spacing around the border or some areas of the border could have a larger gap between adjacent cuts or perforations. For example one or more sides of the rectangular border 42 shown could be completely cut while other sides could have intermittent cuts or perforations. Alternately, the border 42 could be completely cut, in effect separating the message portion 36 from surrounding remaining portions of the front panel 24. Alternately, the border could be "kiss cut" wherein the border 42 is continuously or intermittently cut through only a partial depth of the thickness of the front panel 24. The border could also be die cut.

Figure 2:
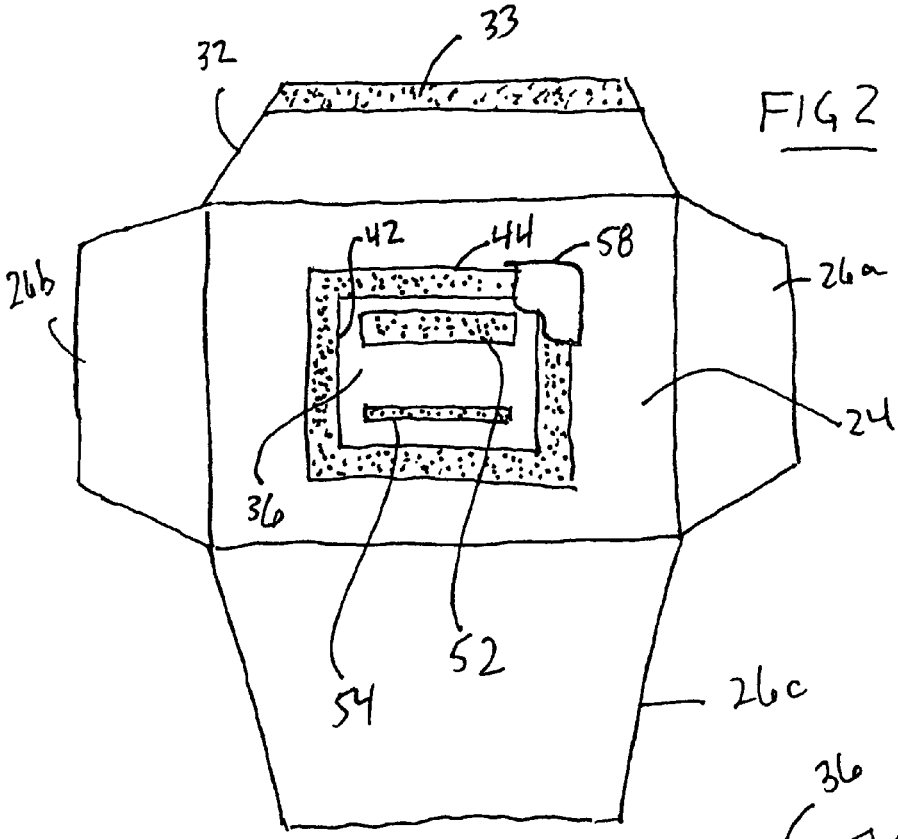
FIG. 2 is a rear view of a blank used to form the envelope shown in FIG. 1 during manufacturing and before folding, with portions of a release sheet removed for clarity.

On a reverse side of the front panel 24, a pattern of adhesive 44 is applied around the border 42. The pattern can be intermittent but according to the illustrated embodiment is a rectangular continuous pattern as shown in FIG. 2. On a rear side of the message portion 36, a multiple re-use adhesive is applied in a first stripe 52 along a top end portion of the message portion and a second stripe 54 along a bottom end portion of the message portion 36. Preferably the multiple re-use adhesive comprises an acrylic, microsphere adhesive system which provides a discontinuous film of adhesive resulting in low peel, removability and stable tack over a period of time, such as GEL-TAC® available from Advanced Polymers International (API), www.msphere.com or PCI Paper Conversions Inc., www.padmaker.com, both of Syracuse, N.Y., U.S. Adhesives which could be used to practice the invention include those adhesives disclosed in U.S. Pat. Nos. 4,495,318; 6,703,096 and 4,781,306, all herein incorporated by reference. The multiple re-use adhesive can be removed with the message portion 36, such that the message portion becomes a repositionable note.

Although two adhesive stripes are shown, it is also encompassed by the invention that only the upper or only the lower stripe is used. When the border is formed by a complete through-cut and the message portion 36 is only held to the envelope by the multiple re-use adhesive and the release sheet 58, it may be advantageous to use two stripes, upper and lower, of similar, to prevent an edge of the message portion 36 from curling outward away from the front panel surface. It is also encompassed by the invention that one or more of the stripes has a different shape, such as a circle, or is intermittently applied.

A release sheet 58 having a size with an outer border substantially equal to, or larger than, the outer expanse of the adhesive pattern 44 is placed onto the adhesive pattern 44 and adhered thereby, and over the stripes 52, 54. This release sheet 58 protects the contents of the envelope from adhering to the stripes 52, 54. The release sheet is composed of a material that will allow the message portion 36 with the stripes 52, 54 to be peeled from the release sheet, retaining the adherence of the stripes for the message portion to be re-adhered to another object.

The adhesive pattern can be composed of removable, ultra-removable or permanent adhesive or any other known adhesive for the application.

Figure 3:
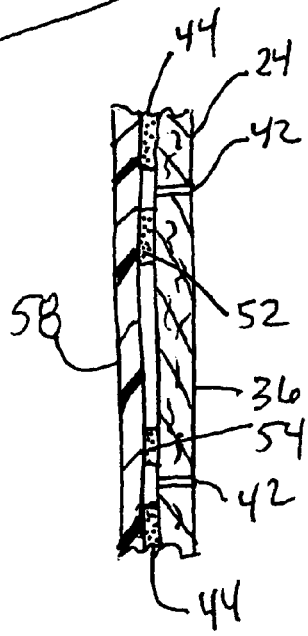
FIG. 3 is a sectional view taken generally along line 3-3 of FIG. 1.
Figure 3A:
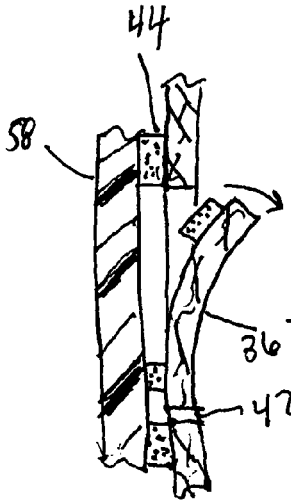
FIG. 3A is a sectional view taken generally along line 3-3 of FIG. 1, but showing a message portion being removed from the envelope.

When a recipient receives the envelope 20, the message portion 36 is removed from the release sheet 58 and the front panel 24 by separation around the border 42 as shown in FIGS. 3 and 3A. When the message portion is a continuous part of the front panel 24 and the border 42 is a weakened border caused by perforations, cuts or die cutting or kiss cutting, the border 42 is broken and the message portion 36 is removed with the adhesive stripes 52, 54.

Figure 4:
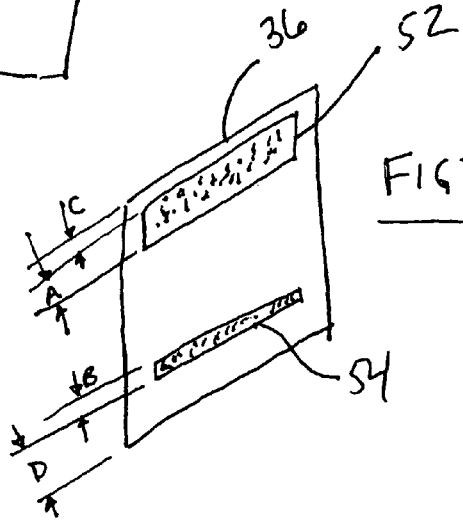
FIG. 4 is a perspective rear view of a portion of the envelope shown in FIG. 1.

FIG. 1 illustrates one embodiment of the envelope 20 having the exemplary dimensions of L=¾ inch and H=½ inch. FIG. 4 illustrates one embodiment of the message portion 36 having exemplary dimensions of A=¾ inch; B=¼ inch; C=1/16 inch and D=⅛ inch.

Figure 5:
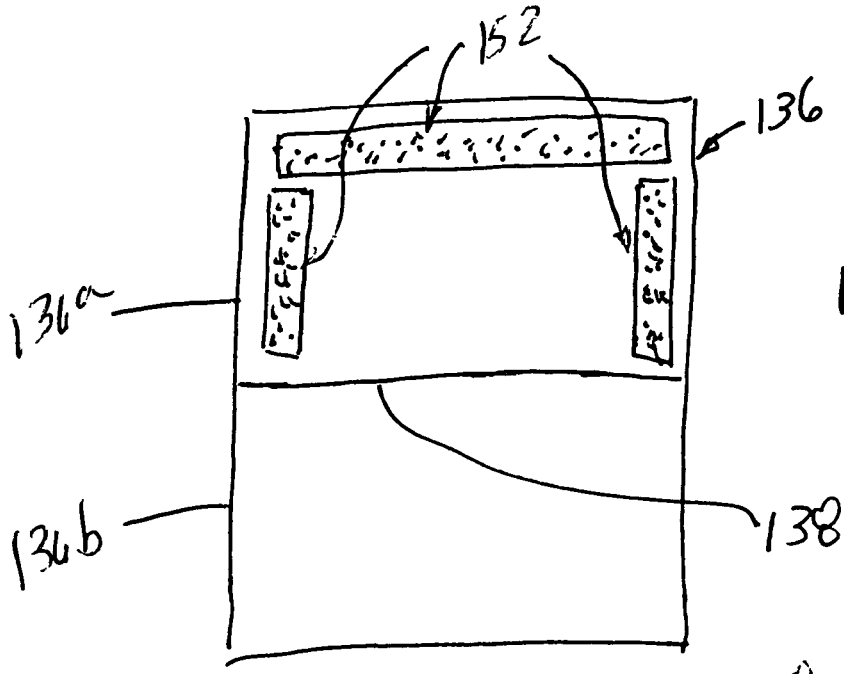
FIG. 5 is a rear view of an alternate embodiment portion to that shown in FIG. 4.
Figure 6:
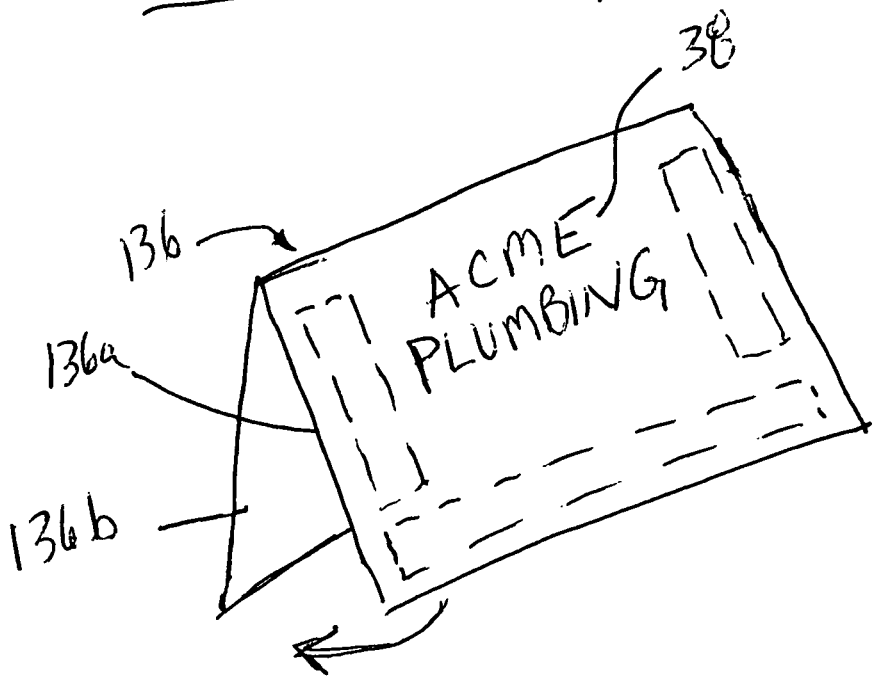
FIG. 6 is a perspective view of the alternate embodiment portion of FIG. 5 shown in a folded configuration.

FIG. 5 illustrates the rear side an alternate embodiment message portion 136 having a central fold line 138 that bisects the message portion 136 into two equal rectangles 136*a*, 136*b*. An adhesive pattern 152 is applied to at least one of the rectangles 136*a*. FIG. 6 illustrates that after the message portion 136 is removed from the release sheet 58 and the front panel 24 (as shown in FIG. 3A), the message portion 136 can be folded in half, flat, wherein the adhesive pattern 152 fixes the two rectangles 136*a*, 136*b* together to form a two ply business card, credit card, stored value card, coupon, etc. The front sides of both rectangles 136*a*, 136*b* can have indicia such that the folded and formed two ply card has indicia on both sides.

From the foregoing, it will be understood that numerous variations and modifications may be effected without departing from the true spirit and scope of the novel concept of the invention. It is to be understood that no limitation with respect to the specific method, apparatus, and product illustrated herein is intended or should be inferred. It is, of course, intended to cover by the appended claims all such modifications as fall within the scope of the claims.

The invention claimed is:

1. An envelope comprising:

a front wall and an underlying back wall, said front wall and said back wall connected around mutual edges to form an enclosed pouch, wherein one of said front wall and said back wall includes a message portion separable from remaining portions of said one of said front wall and said back wall; and a release sheet secured to an inside surface of said one of said front wall and said back wall underlying said message portion;

wherein said message portion comprises areas of multiple reuse adhesive and is secured to said release sheet by said multiple reuse adhesive to form a repositionable note once removed from said one of said front wall and said back wall, said areas of multiple reuse adhesive being less than co-extensive with the message portion such that when said repositionable note is adhered by said areas of multiple reuse adhesive, an edge of said message portion remains unsecured;

wherein said areas of multiple reuse adhesive comprises a first portion substantially spanning a top edge portion of said message portion and a second portion substantially arranged within a bottom edge portion of said message portion;

wherein said second portion is smaller in area than said first portion.

2. The envelope according to claim 1, wherein said envelope comprises a pattern of adhesive applied between said one of said front wall and said back wall and said release sheet, said release sheet secured to said one of said front wall and said back wall by said pattern.

3. The envelope according to claim 2, wherein said pattern substantially continuously surrounds said message portion.

4. The envelope according to claim 1, wherein said multiple reuse adhesive comprises an acrylic, microsphere adhesive.

5. The envelope according to claim 1, wherein said multiple reuse adhesive comprises a stripe portion substantially spanning a top edge portion of said message portion.

6. The envelope according to claim 1, wherein said message portion is formed by perforating said one of said front wall and said back wall to make said message portion removable from said remaining portions.

7. The envelope according to claim 1, wherein said message portion is completely separated from said remaining portions and secured to said release portion by said multiple reuse adhesive.

8. The envelope according to claim 1, wherein said message portion comprises a fold line that defines two equal area halves of said message portion, wherein said multiple reuse adhesive is arranged to secure said two equal halves together once separated from said remaining portions and folded, to form a two ply message portion.

9. An envelope comprising:

a front wall and an overlying back wall, said front wall and said back wall connected around mutual edges to form an enclosed pouch, wherein one of said front wall and said back wall includes a message portion separable from remaining portions of said one of said front wall and said back wall; and a release sheet secured to an inside surface of said one of said front wall and said back wall overlying said message portion;

wherein said message portion comprises areas of multiple reuse adhesive and is secured to said release sheet by said multiple reuse adhesive to form a repositionable note once removed from said one of said front wall and said back wall;

wherein said message portion comprises a fold line that defines two equal area halves of said message portion, wherein said multiple reuse adhesive is arranged to secure said two equal halves together once separated from said remaining portions and folded, to form a two ply message portion.

10. The envelope according to claim 9, wherein said envelope comprises a pattern of adhesive applied between said one of said front wall and said back wall and said release sheet, said release sheet secured to said one of said front wall and said back wall by said pattern.

11. The envelope according to claim 10, wherein said pattern substantially continuously surrounds said message portion.

12. The envelope according to claim 9, wherein said multiple reuse adhesive comprises an acrylic, microsphere adhesive.

13. The envelope according to claim 9, wherein said multiple reuse adhesive comprises a first portion substantially spanning a top edge portion of said message portion and a second portion substantially spanning a bottom edge portion of said message portion.

14. The envelope according to claim 13, wherein said second portion is smaller in area than said first portion.

15. The envelope according to claim 9, wherein said multiple reuse adhesive comprises a stripe portion substantially spanning a top edge portion of said message portion.

16. The envelope according to claim 9, wherein said message portion is formed by perforating said one of said front wall and said back wall to make said message portion removable from said remaining portions.

17. The envelope according to claim 9, wherein said message portion is completely separated from said remaining portions and secured to said release portion by said multiple reuse adhesive.

* * * * *